United States Patent [19]

Looney

[11] 4,055,339

[45] Oct. 25, 1977

[54] SORTER APPARATUS

[75] Inventor: John H. Looney, Fairport, N.Y.

[73] Assignee: Xerox Corporation, Stamford, Conn.

[21] Appl. No.: 763,276

[22] Filed: Jan. 27, 1977

[51] Int. Cl.[2] ..... B65H 39/10

[52] U.S. Cl. ..... 271/173

[58] Field of Search ..... 271/64, 173; 270/58

[56] References Cited

U.S. PATENT DOCUMENTS

| | | | |
|---|---|---|---|
| 3,788,640 | 1/1974 | Stemmle | 271/173 |
| 3,977,667 | 8/1976 | Cross | 271/173 X |

*Primary Examiner*—Richard A. Schacher

[57] ABSTRACT

A multi-bin sorter comprised of at least two bin arrays supported upon a rotatable turntable adapted to bring individual bins selectively into operative disposition with an inlet or discharge station, or both. Each bin array is comprised of a series of vertically oriented bins with elevator means to selectively raise and lower the bins to bring the individual bins into and out of operative juxtaposition with the inlet and/or discharge stations. A fixed cam surface is arranged to increase the size of the moving bin mouths at the point of sheet inlet and discharge as they move relative thereto to facilitate the sorting operation.

3 Claims, 9 Drawing Figures

SORTER APPARATUS

This invention relates to an improved sorting system, and more particularly, to a moving bin sorter in which the bin inlets are opened upon arrival of a sheet for that particular bin.

With the advent of higher speed and more sophisticated copying producing machines, printing presses, and the like, considerations as to how the mass of copies generated can best and most effectively be handled has assumed increasing importance. One way has been to provide a sorter at the machine output, the sorter serving to place the copies in accordance with a selected program in various bins of the sorter. While sorters as known to the art have taken various and sundry forms, many suffer from an inability to provide or permit a relatively uninterrupted operational system. This is in the sense that the feed of sheets to the sorter must be interrupted when the sorter has been filled and while unloading of the sorter takes place. Where, for example, the source of sheets to be sorted is a relatively high speed copying machine, the machine must be stopped during this period with attendant loss in production time.

A problem arising with present sorting machines is that they have large and bulky units to effect the desired storage of sheets. Recently there has been increased activity in the design and development of sorter units which have bin opening devices to facilitate the distribution of a large number of sheets into a relatively confined area as described for example in U.S. Pat. Nos. 3,774,902 and 3,788,640. The present invention is an improvement over the existing devices as described in the foregoing patents since it provides the bin opening operation in a simpler and highly reliable manner.

It is therefore a principal object of the present invention to provide a new and improved sorting or collating apparatus.

It is a further object of the present invention to enhance the delivery of copy sheets to a movng bin sorting apparatus.

It is an object of the present invention to achieve sorting of copy sheets in moving bins simply and reliably.

It is an object of the present invention to reduce significantly the level of noise normally associated with the sorting of sheet material.

Other objects and advantages will be apparent from the ensuing description and drawings in which FIG. 1 is a side view schematic of a sorting system incorporating a bin opening mechanism according to the present invention;

Figure 1:
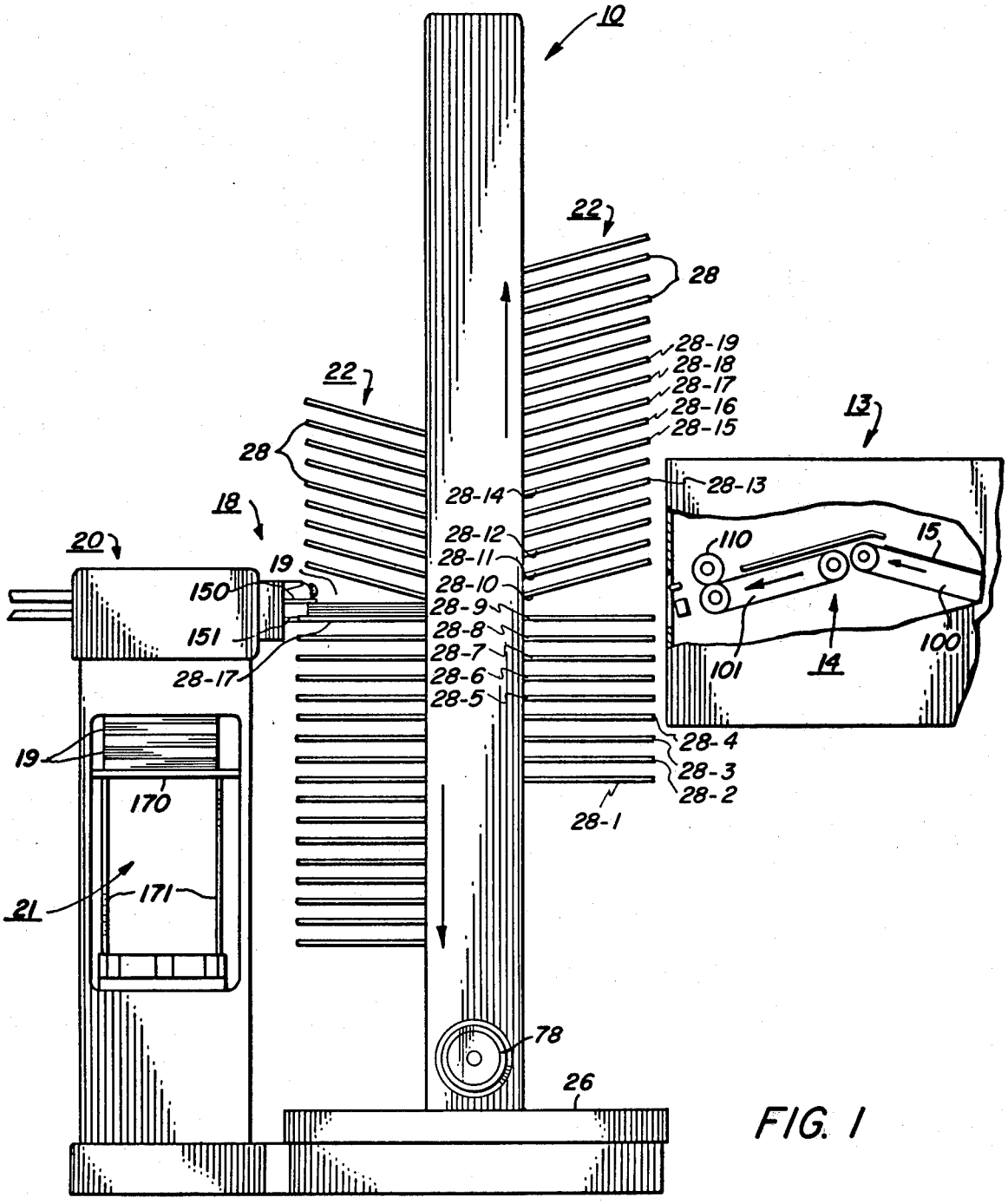
Figure 2:
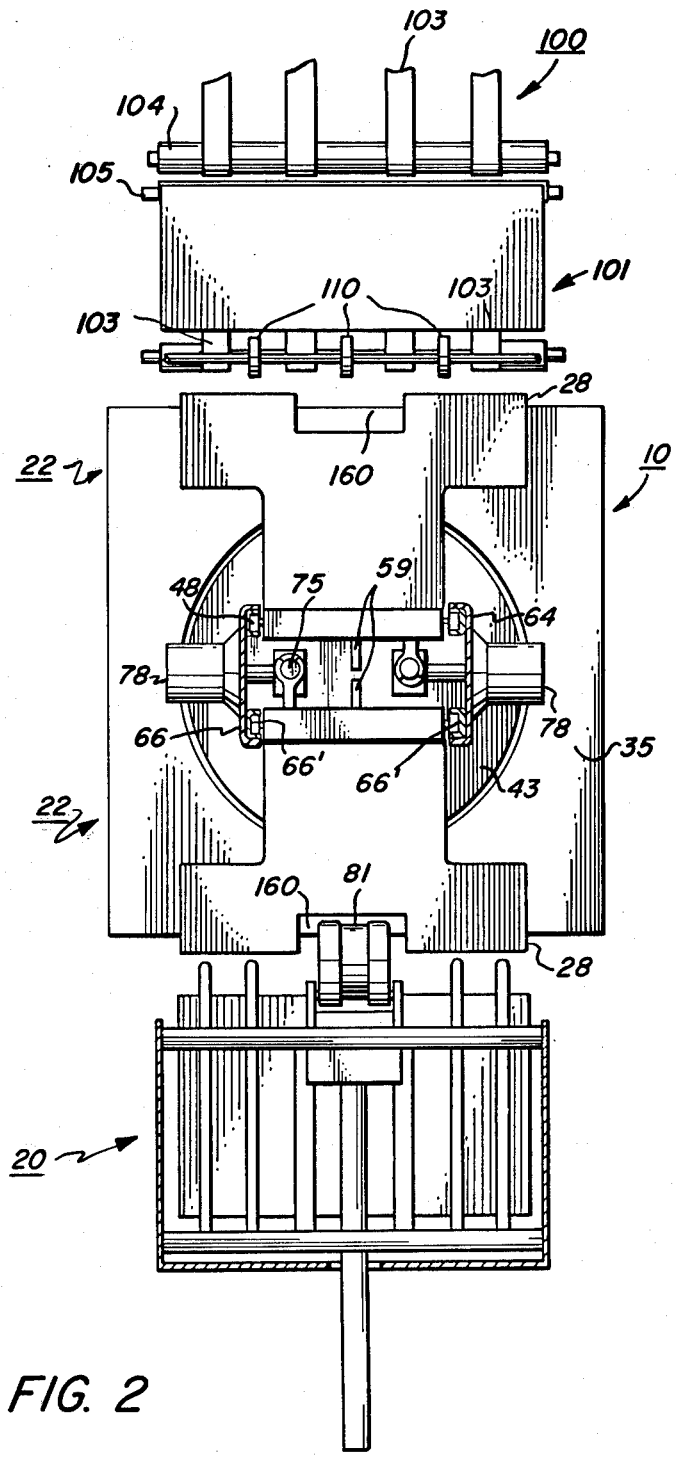
FIG. 2 is a top view schematic of the system shown in FIG. 1.

Referring particularly to FIGS. 1 and 2 of the drawings, the sorter is designated generally by the numeral 10 and is similar to that described in U.S. Pat No. 3,995,748 to Looney which is commonly assigned herewith. Sorter 10 there forms an integral part of an on-line finishing system which includes a source of sheets to be sorted, such as a copier or duplicator (not shown), a sorter loading station 13 including transport 14 for transporting sheets 15 to be sorted from the copier to sorter 10, and a sorter unloading station 20 including clamp 18 for withdrawing the packs 19 from the sorter bins and stacking elevator 21 for receiving the sheet packs 19. While sorter 10 is illustrated in FIG. 1 as comprising an integral part of an on-line finishing system, it will be understood that sorter 10 may be used separately, or as part of an off-line sorting or finishing system.

In the preferred embodiment, sorter 10 comprises a pair of bin arrays 22 disposed back to back with the bin entrances facing outwardly. Bin arrays 22 are supported in a substantially vertical posture upon a rotatable base or turntable 26. Each bin array 22 comprises a series of discreet sheet receiving trays 28 supported for substantially vertical up and down movement in unison on turntable 26. As a result, the individual trays 28 are brought into operative juxtaposition with the outlet of loading station 13 and the inlet to unloading station 20 for loading and unloading, respectively.

A turntable 26 includes a base 35 for supporting sorter 10. Suitable casters or rollers (not shown) may be provided on base 35 to facilitate moving of sorter 10 from place to place. Base 35 carries a rotatable support in the form of the inner race 36 of bearing means 37. The outer race 38 of bearing 37 forms a drive pulley which is suitably coupled by means of belt and pulley arrangement 39 with turntable drive motor 41. Outer race 38 carries a generally horizontal support plate 43. A vertical tower assembly 65 which supports the bin arrays 22 is mounted on plate 43.

Figure 3:
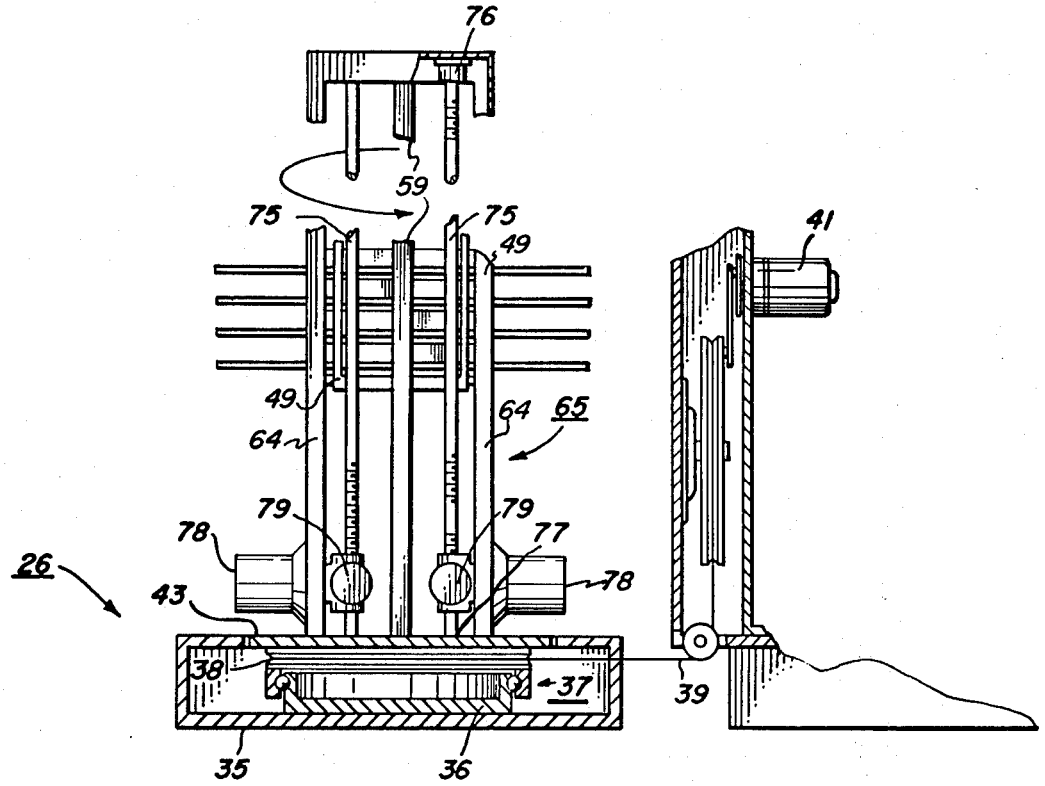
FIG. 3 is an enlarged view in cross section showing details of the turntable support for the sorter shown in FIG. 1.
Figure 4:
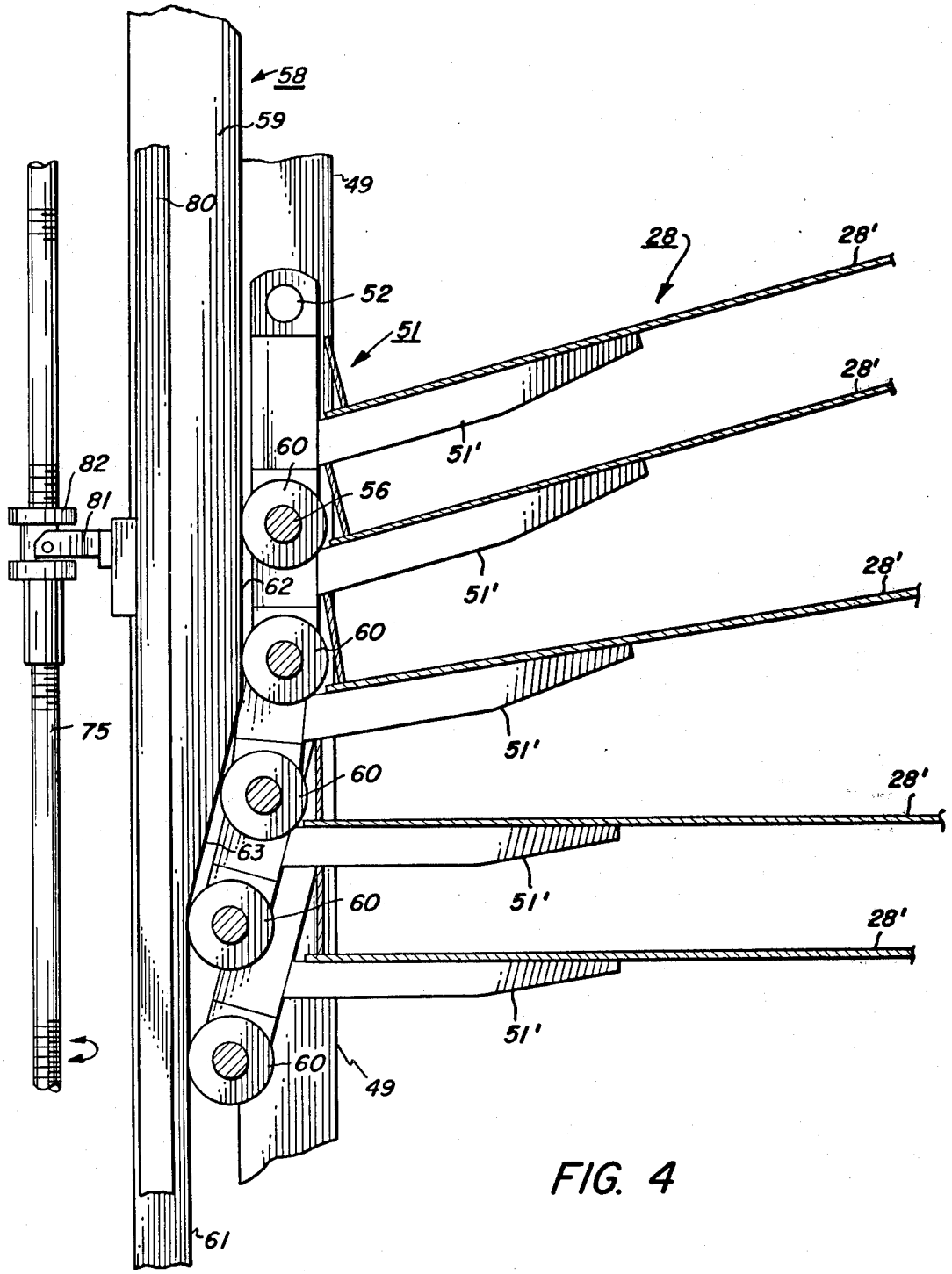
FIG. 4 is an enlarged view in cross section and with parts broken away showing details of the bin opening mechanism according to the invention.
Figure 5:
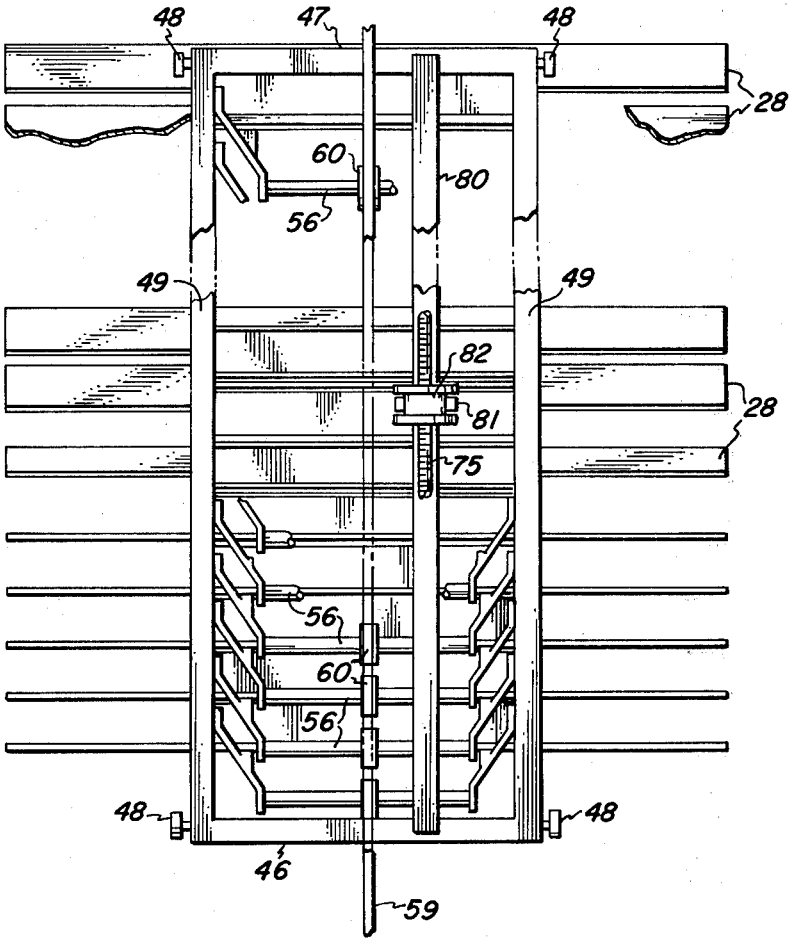
FIG. 5 is a rear view of one sorting array for the sorter shown in FIG. 1.
Figure 6:
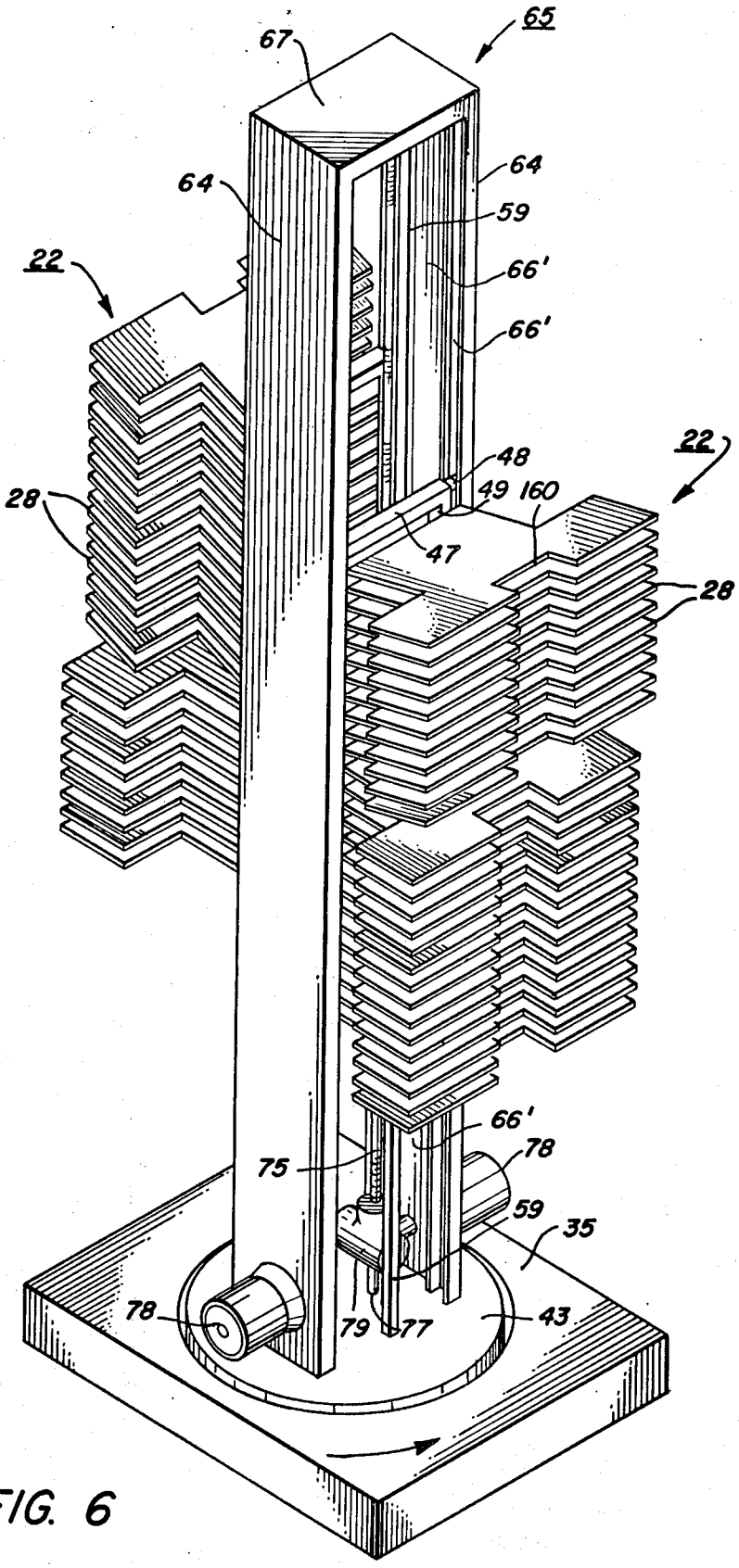
FIG. 6 is an isometric view showing details of the center support for the sorter shown in FIG 1.
Figure 7:
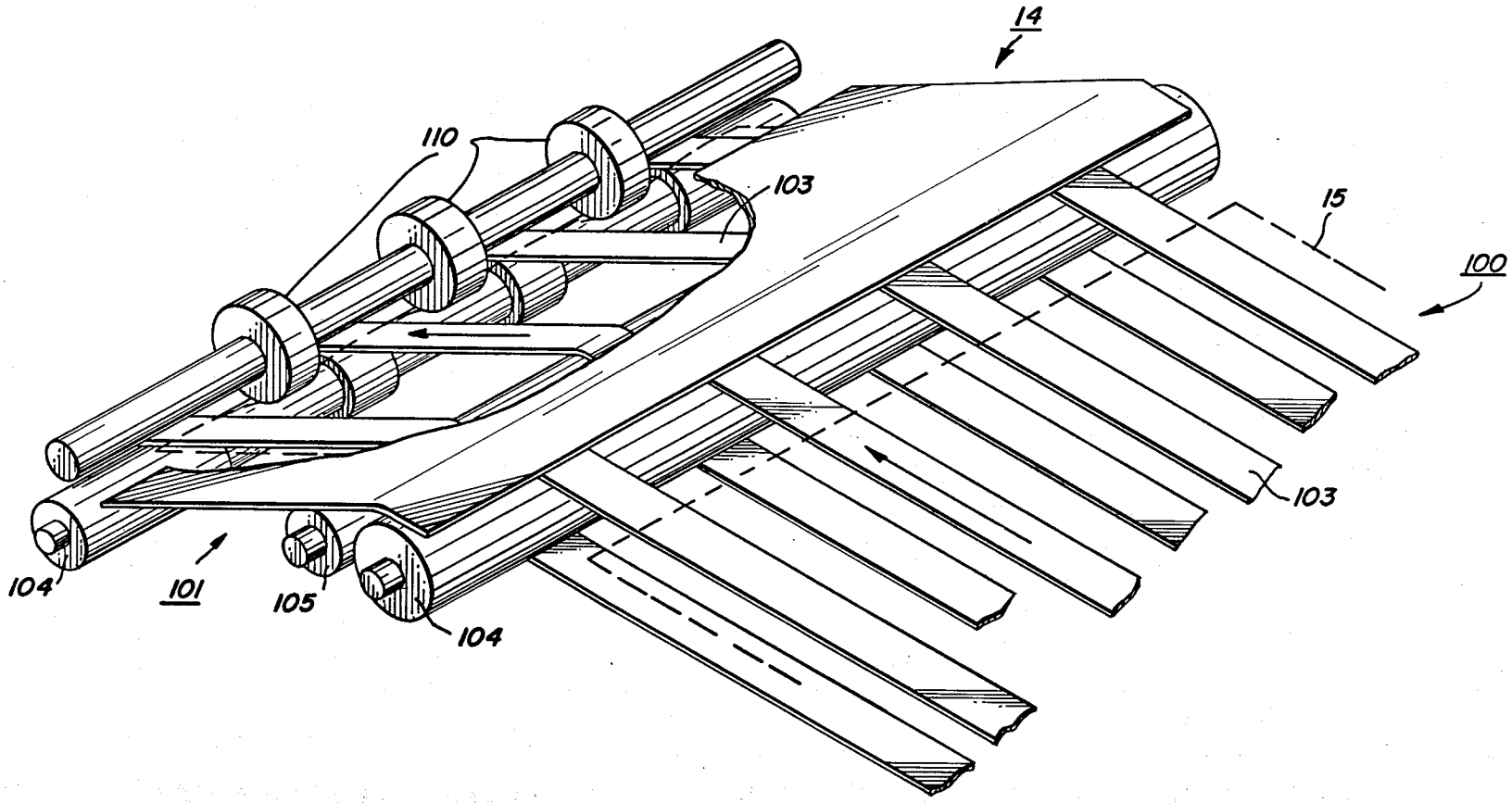
FIG. 7 is an isometric view of the inlet transport of the sorting system shown in FIG. 1.

Referring to FIGS. 3-5, bin arrays 22 each have a generally rectangular frame like support structure comprised of bottom and top cross members 46, 47, and vertical side members 49. Side members 49 carry upper and lower mounting wheels 48 which ride in tracks 66' of channels 66.

A tower assembly 65 includes a pair of spaced side supports 64. A pair of channel-shaped members 66 are arranged within each support 64 with the open channel section of each channel 66 facing inwardly to provide a track 66' within which wheels 48 of bin arrays 22 ride. An upper cross support 67 is provided between the support tracks 66.

Tower assembly 65 includes a threaded drive member 75 for each bin array 22. Each drive member 75 is supported in upper and lower bearing blocks 76, 77 mounted on cross support 67 and plate 43 respectively. A reversible drive motor 78 is provided for each bin array, motors 78 being mounted on side supports 64 of tower assembly 65 adjacent the bottom thereof. Motors 78 are drivingly connected to their respective drive members by suitable shaft and gear means 79.

A bin drive bracket 80 is provided for each bin array 22, bracket 80 being conveniently secured to the bottom and top cross members 46, 47 respectively of the bin array frame. A drive yoke 81, secured to bracket 80, carries drive nut 82 which is threadedly engaged with drive member 75. The tower assembly 65 including threaded drive members 75, motors 78, and yokes 81 may be conveniently enclosed by a suitable decorative housing (not shown).

Inlet transport 14 of loading station 13 comprises a pair of conveyors 100, 101, each conveyor preferably consisting of multiple belts 103 stretched across supporting rolls 104, 105. Rolls 104 of conveyors 100, 101 may be conveniently driven to operate conveyors 100, 101 in the direction shown by the solid line arrow from a suitable power source (not shown). In that arrangement, rolls 105 function as idler rolls. Conveyors 100, 101, which are suitably supported between the outlet of the copier and the inlet to sorter 10, are driven at speeds suitable to bring the sheets discharged from the copier to sorter 10 in proper timed relationship to movement of the bin array 22 opposite thereto. To stiffen the sheets 15 in the direction of sheet travel and prevent sheet buckling, a stiffening roll set 110 is provided opposite rolls 104 of transport 101, rolls 110 being supported between rolls 104 with the roll peripheries overlaying each other. As a result, sheets 15 passing therebetween are bent or curved longitudinally to improve sheet stiffness.

Figure 8:
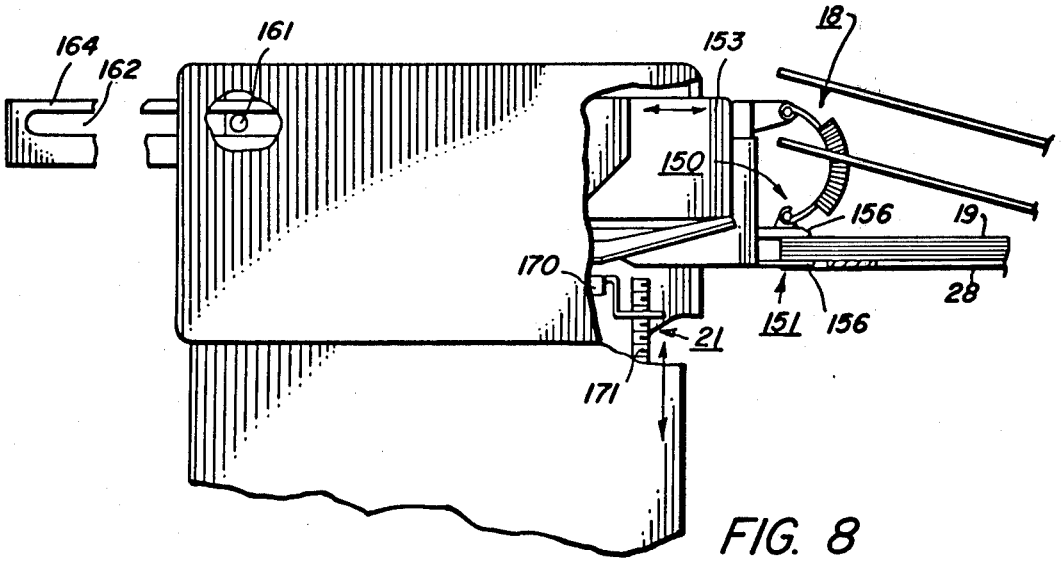
FIG. 8 is a side view schematic of the finishing station.

Referring now to FIGS. 1 and 8, clamp 18 of unloading station 20 comprises, as shown schematically there, cooperating upper and lower jaws 150, 151 respectively. In the exemplary arrangement shown, upper jaw 150 is pivotally supported on carriage 153 while lower jaw 151 is fixed to the carriage 153. Both jaws 150, 151 have projecting gripping ends 156 adapted to grasp the pack 19 of sheets upon isertion of the clamp 18 within a selected tray 28 as will appear. To accommodate insertion of clamp 18 into the tray confines, a portion of the leading edge of each tray 28 is recessed at 160 (as seen in FIG. 2). Suitable means (not shown) are provided to pivot upper jaw 150 to open and close clamp 18.

Carriage 153 is suitably supported for reciprocating movement, represented by pin and slot connection 161, 162 on a stationary frame member 164. For this purpose, suitable driving means (not shown) are provided to reciprocate carriage 153, and clamp 18, back and forth between the bin array 22 and stacking elevator 21.

Stacking elevator 21 is disposed below the path of travel of clamp 8 to receive the finished packs 19 of sheets 15 as the packs withdrawn from sorter 10 are released by clamp 18. Elevator 21 includes a pack receiving platform 170 supported for vertical up and down movement by shafts 171. Suitable elevator drive and control means (not shown) are provided to raise the lower elevator 21 in response to the height of the stacks 19 thereon, it being understood that elevator 21, when empty, is raised to a relatively high position just below the path of travel of clamp 18 and then, as stacks 19 are placed thereon, elevator 21 is incrementally lowered until the elevator 21 capacity is reached. At this point, piling of additional stacks 19 is terminated while stacking elevator 21 is emptied following which the process is repeated.

In accordance with the present invention, the individual trays 28 that comprise each bin array 22 are pivotally attached to side members 49 of the bin array frame by means of a pair of T-shaped supports 51. Each support 51 has the projecting leg portion 51' secured to the tray underside adjacent each side thereof with one end of the T-section pivotally attached to the adjoining side member 49 by pin 52. The opposite branch of the support T-section 51, has an opening therein within which a cross axle 56 is disposed. Axle 56, which extends between each pair of supports 51, carries a roller type follower 60 which rides on cam track 58 of a vertical cam member 59.

Cam member 59 and follower 60 control the angular disposition of trays 28. Cam member 59 is supported between plate 43, and cross support 67, it being understood that a cam member 59 is provided for each bin array 22 as part of tower assembly 65. Cam track 58, which cooperates with followers 60 of each tray 28 to control the angle or disposition of trays 28, has lower and upper vertical sections 61, 62 with an inclined ramp 63 therebetween. As noted, the followers 60 of each tray 28 ride on cam track 58, to determine the tilt or angle of inclination of the tray associated therewith.

Figure 9:
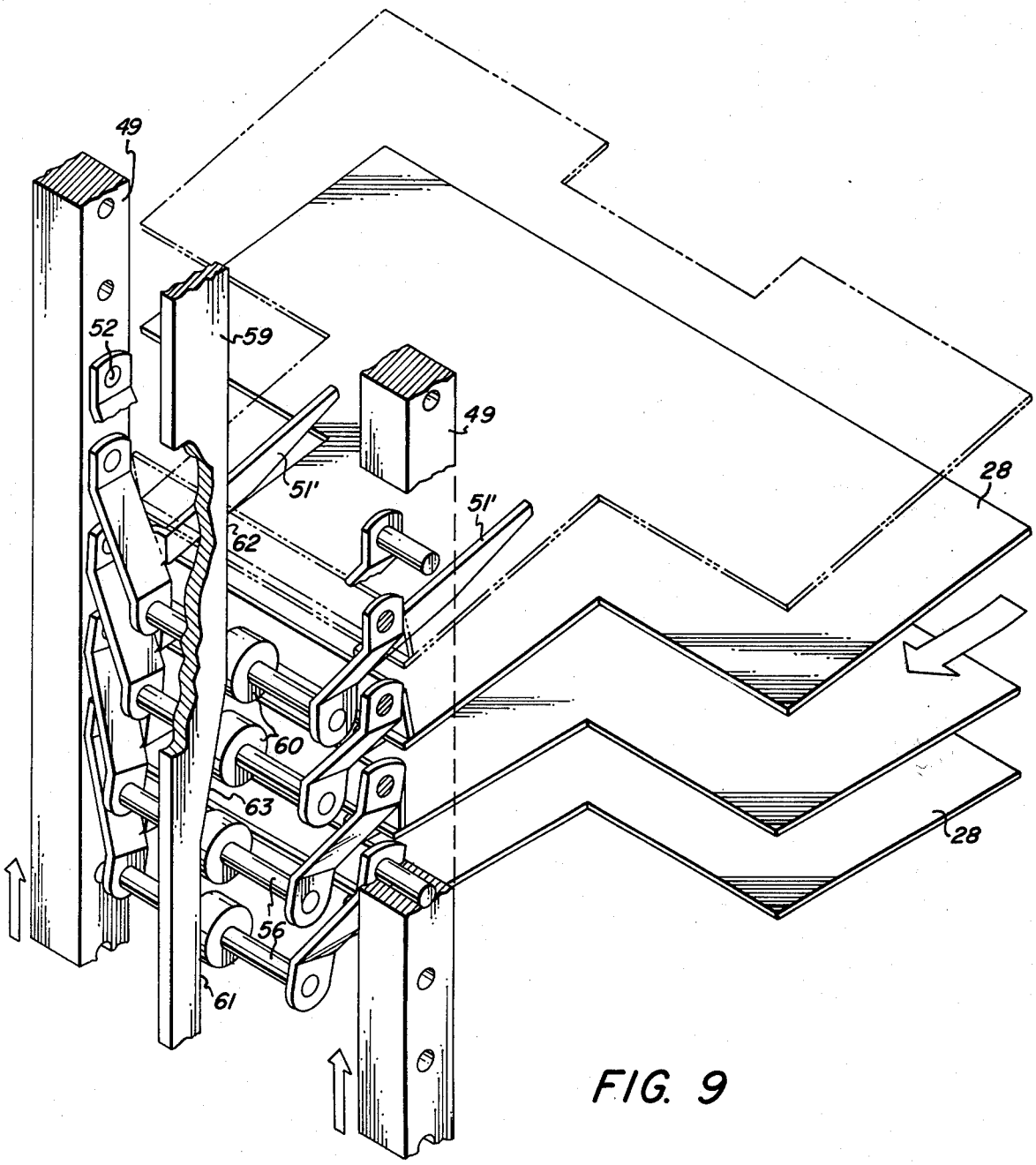
FIG. 9 is an isometric view illustrating still other details of the bin opening mechanism of the invention.

It will now be appreciated that movement of each follower from one section 61 or 62 across ramp 63 to the other section 62 or 61 causes the tray 28 associated therewith to pivot or swing to a new position as best shown in FIGS. 4 and 9. As a result, the relative spacing between the leading or inlet edges 28' of adjoining or succeeding trays 28 as the followers thereof move over ramp 63 of cam track 58 is temporarily increased, resulting in an enlarged tray mouth. With ramp 63 of cam track 58 adjacent the outlet of loading station 13 and the inlet to unloading station 20, clamp 18, the enlarged tray mouth facilitates loading and unloading of the trays 28.

In operation, sorter 10 is set with one bin array 22 disposed in operative facing relationship to the outlet of conveyor 101 of sheet transport 14. The second sorting array is, in the two bin sorter shown, opposite unloading station 20. Conveniently, bin arrays 22, are set in a predetermined starting position, i.e. both bin arrays 22 being in the uppermost or raised position. In the position shown in FIG. 1, the tray 28—9 of the bin array 22 has been pivoted downwardly (on the assumption that the bin array is moving downwardly in the direction of the solid line arrow) to a more nearly horizontal position as a result of the disposition of follower 60 thereof on the lower section 61 of cam track 58. The next tray 28–10 above tray 28–9, as well as the remaining trays thereabove that make up the bin array 22, are disposed in a more steeply angled position due to the disposition of their respective followers 60 on the upper section 62 of cam track 58. As a result, the mouth to the tray 28–9, the upper surface of which is delineated by the bottom of tray 28–10, is widened to facilitate entry of a sheet or sheets therewithin. In a similar manner, the mouth of the tray opposite the inlet to unloading station 21 of the second bin array 22 is widened as that bin array moves up or down to thereby facilitate unloading of a sheet-pack 19 therefrom.

To facilitate explanation, it is assumed that 5 copies of a 19 page document or book are to be made, and that the bin array 22 opposite loading station 13 has been raised to the uppermost position. The first sheet, representing the first page of the first copy of the book, is discharged by transport 14 into the bottom-most tray 28–1 of the bin array 22 opposite thereto. The bin array 22 is lowered by bin array motor 77, and as the bin array moves downwardly, the follower 60 of each tray rides down ramp 63 onto the lower section 61 of cam track 58 to temporarily widen the bin mouth as the bin comes opposite the outlet of conveyor 101 of transport 14. As the trays 28–2 through 28–19 come into operative position opposite conveyor 101, a copy representing the first page of the exemplary book, is inserted therewithin.

Following insertion of the last copy of the first page, i.e. copy number 19, in tray 28–19 of bin array 22, the process is repeated for pages 2, 3, 4 and 5 of the exemplary book. Conveniently, the first copy of page 2 of the exemplary book may be inserted into tray 28–19 which is in position opposite conveyor 101. Following this, the bin array 22 may be raised to open the succeeding mouths of trays 28–19 through 28–1 progression and insert the copies of page 2 in the succeeding trays. The above process is repeated until the last copy of page 5 of the exemplary book has been made.

Following completion of the sorting operation described above, i.e., insertion of the 19th copy of page 5 of the book in tray 28–19, turntable motor 41 is actuated to rotate turntable 26 and the pair of bin arrays 22 thereon through 180° to present a fresh bin array 22 to transport 14 for receipt of additional copies (if further copies are to be made). At the same time, the used bin array, containing nineteen complete copies of the exemplary book, is disposed facing unloading station 20. To facilitate rotation of turntable 26 and the bin arrays 22 thereon, the bin arrays are raised to their uppermost position to assure clearance between the rotating bin arrays and adjoining parts of the system, i.e. inlet transport 19, clamp and so forth.

Here, in a similar matter, the used bin array may be moved downwardly to bring each individual tray of that array temporarily opposite clamp 18 of unloading station 20. As described, the interaction of cam and follower 58, 60 widens the mouth of the tray as the tray comes opposite clamp 18 to facilitate grasping and withdrawal of the finished pack 19 by clamp 18. With a tray, i.e. tray 28–17 of bin array 22 opposite clamp 18, carriage 153 is advanced to bring the clamp, with jaws 150, 151 opened, partially into the tray with the jaw gripping ends 156 overlaying the edge of the finished pack in the tray. Jaws 150, 151 are then closed to grip the pack, this being effected by swinging upper jaw 150 down toward the lower fixed jaw 151. Carriage 153 is then retracted to withdraw the clamp 18 together with the pack 19 gripped therewithin from the tray and bring the pack to a point opposite platform 170 of stacking elevator 21. At this point, clamp jaws 150, 151 may be opened to allow the finished pack to drop onto the elevator 21. The above process is repeated to empty each of the trays 28, the bin array being moved downwardly to present each tray to clamp 18. Following emptying of the last tray, the bin array may be raised back to the start position and the bin array is ready for loading.

When the number of copies to be made exceed the capacity of a bin array 22, the second bin array may be used to continue sorting while the previously loaded bin array is being emptied at unloading station 20. As will be appreciated, an almost endless number of copies can be produced in this manner.

It will be understood that bin arrays 22 may be loaded and/or unloaded during downward or upward travel of the bin arrays 22. While a pair of bin arrays 22 has been illustrated on turntable 26, additional bin arrays, e.g. four may be contemplated.

While the invention has been described with reference to the structure disclosed, it is not confined to the details set forth, but is intended to cover such modifications or changes as may come within the scope of the following claims.

What is claimed is:

1. Improved sorting apparatus comprising:

a frame;

a plurality of bin members arranged in a vertical array supported for sliding and pivotal movement relative to said frame;

means for moving said bin members relative to said frame;

an elongated cam member coextensive with the vertical array of bins, said cam member having a predetermined camming profile which extends in a vertical direction then inclines to define a ramp at a sheet entering station associated with said moving bin members, and then extends in a vertical direction for the remaining extent thereof;

said bin members each having cam follower means associated therewith positioned to move in contact with said cam member whereby as each of said bin members is moved past the sheet entering station pivotable movement to imparted thereto to effect spreading movement between said bin members thereat.

2. Apparatus according to claim 1 wherein said cam follower means includes a rotary member connected to said bin member.

3. Apparatus according to claim 2 wherein said rotary member is carried by an axle member which is pivotally supported at the ends thereof.

* * * * *